US011098879B2

(12) United States Patent
Wilson

(10) Patent No.: US 11,098,879 B2
(45) **Date of Patent: *Aug. 24, 2021**

(54) LIGHTING FIXTURE FOR USE IN A SECURE DETENTION FACILITY

(71) Applicant: KENALL MANUFACTURING COMPANY, Kenosha, WI (US)

(72) Inventor: Brad Wilson, Twin Lakes, WI (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/804,962

(22) Filed: Feb. 28, 2020

(65) Prior Publication Data

US 2020/0200369 A1 Jun. 25, 2020

Related U.S. Application Data

(63) Continuation of application No. 16/104,731, filed on Aug. 17, 2018, now Pat. No. 10,627,080.

(51) Int. Cl.

| | |
|---|---|
| ***F21V 15/01*** | (2006.01) |
| ***F21V 23/00*** | (2015.01) |
| ***F21V 17/06*** | (2006.01) |
| ***F21V 5/04*** | (2006.01) |
| ***F21V 19/00*** | (2006.01) |
| *F21Y 115/10* | (2016.01) |

(52) U.S. Cl.

CPC ..... *F21V 15/01* (2013.01); *F21V 5/04* (2013.01); *F21V 17/06* (2013.01); *F21V 19/001* (2013.01); *F21V 23/009* (2013.01); *F21Y 2115/10* (2016.08)

(58) Field of Classification Search

CPC ..... F21V 15/01; F21V 23/009; F21V 17/06; F21V 19/001; F21S 8/03

See application file for complete search history.

(56) References Cited

U.S. PATENT DOCUMENTS

| | | | | |
|---|---|---|---|---|
| 7,264,384 | B1 * | 9/2007 | Ryan | B63B 17/02 362/477 |
| 7,431,473 | B2 ‡ | 10/2008 | Wilson | F21S 8/033 362/14 |
| 8,496,364 | B2 | 7/2013 | Davis | |
| 2005/0024856 | A1 | 2/2005 | Helenowski | |

(Continued)

*Primary Examiner* — Donald L Raleigh

(74) *Attorney, Agent, or Firm* — Marshall, Gerstein & Borun LLP; Randall G. Rueth

(57) ABSTRACT

A lighting fixture for use in a security detention facility. The lighting fixture includes a unitary housing adapted to be mounted to a surface in the security detention facility, a first bracket disposed within the unitary housing, and a light source coupled to the first bracket, the light source including a plurality of light-emitting diodes (LEDs). When the unitary housing is mounted to the surface in the security detention facility, the internal components of the lighting fixture (e.g., the light source) are not accessible, such that inmates of the security detention facility are unable to damage the internal components of the lighting fixture or access the internal components of the lighting fixture to hide weapons or contraband therein or use those components to harm themselves, other inmates, and/or security personnel.

18 Claims, 8 Drawing Sheets

(56) References Cited

U.S. PATENT DOCUMENTS

| | | | | |
|---|---|---|---|---|
| 2007/0086198 | A1* | 4/2007 | Wilson | F21V 3/00 362/382 |
| 2012/0236578 | A1* | 9/2012 | Davis | F21V 17/107 362/375 |
| 2013/0051008 | A1* | 2/2013 | Shew | F21S 9/022 362/235 |
| 2014/0247603 | A1* | 9/2014 | Cruz | F21K 9/60 362/311.01 |
| 2016/0305637 | A1* | 10/2016 | Brunelli | F21V 21/30 |

* cited by examiner
‡ imported from a related application

LIGHTING FIXTURE FOR USE IN A SECURE DETENTION FACILITY

FIELD

The present disclosure generally relates to lighting fixtures and, more particularly, to a lighting fixture for use in a secure detention facility.

BACKGROUND

Secure detention facilities, e.g., jails and prisons, are commonly used to forcibly confine persons and deny those persons a variety of freedoms as punishment for crimes committed by such persons against the public. Some inmates of secure detention facilities will be well-behaved, while others will not and will instead resort to criminal behavior, including vandalism and violent behavior against themselves, other inmates, security personnel, or combinations thereof, at those secure detention facilities. Such inmates may, for example, attempt to destroy lighting fixtures installed in their secure detention facility. Inmates may alternatively or additionally use these lighting fixtures as hiding places for weapons or contraband, or even use components of those lighting fixtures to commit violent acts against themselves, other inmates, and/or security personnel. For example, an inmate may spend hours and hours breaking bolts lose from a lighting fixture in order to access one or more components of that lighting fixture that can be used to harm other inmates and/or security personnel.

SUMMARY

One aspect of the present disclosure provides a lighting fixture for use in a security detention facility. The lighting fixture includes a unitary housing adapted to be mounted to a surface in the security detention facility, a first bracket disposed within the unitary housing, and a light source coupled to the first bracket, the light source including a plurality of light-emitting diodes (LEDs). When the unitary housing is mounted to the surface in the security detention facility, the light source is not accessible.

Another aspect of the present disclosure provides a lighting fixture for use in a security detention facility. The lighting fixture includes a unitary housing adapted to be mounted to a surface in the security detention facility, a first bracket disposed within the unitary housing, a light source coupled to the first bracket, the light source including a plurality of light-emitting diodes (LEDs), a pair of second brackets disposed within the unitary housing, and a lens fixedly coupled to the unitary housing, the lens seated against the second brackets within the unitary housing.

Another aspect of the present disclosure provides a lighting fixture for use in a security detention facility. The lighting fixture includes a unitary housing adapted to be mounted to a surface in the security detention facility, a first bracket disposed within the unitary housing, and a light source coupled to the first bracket, the light source includes a plurality of light-emitting diodes (LEDs). The lighting fixture also includes a pair of second brackets fixedly disposed within the unitary housing, a lens seated against the second bracket within the unitary housing, a driver configured to electrically power the light source, and a driver cover mounted to the first bracket, the driver disposed between the first bracket and the driver cover.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1:
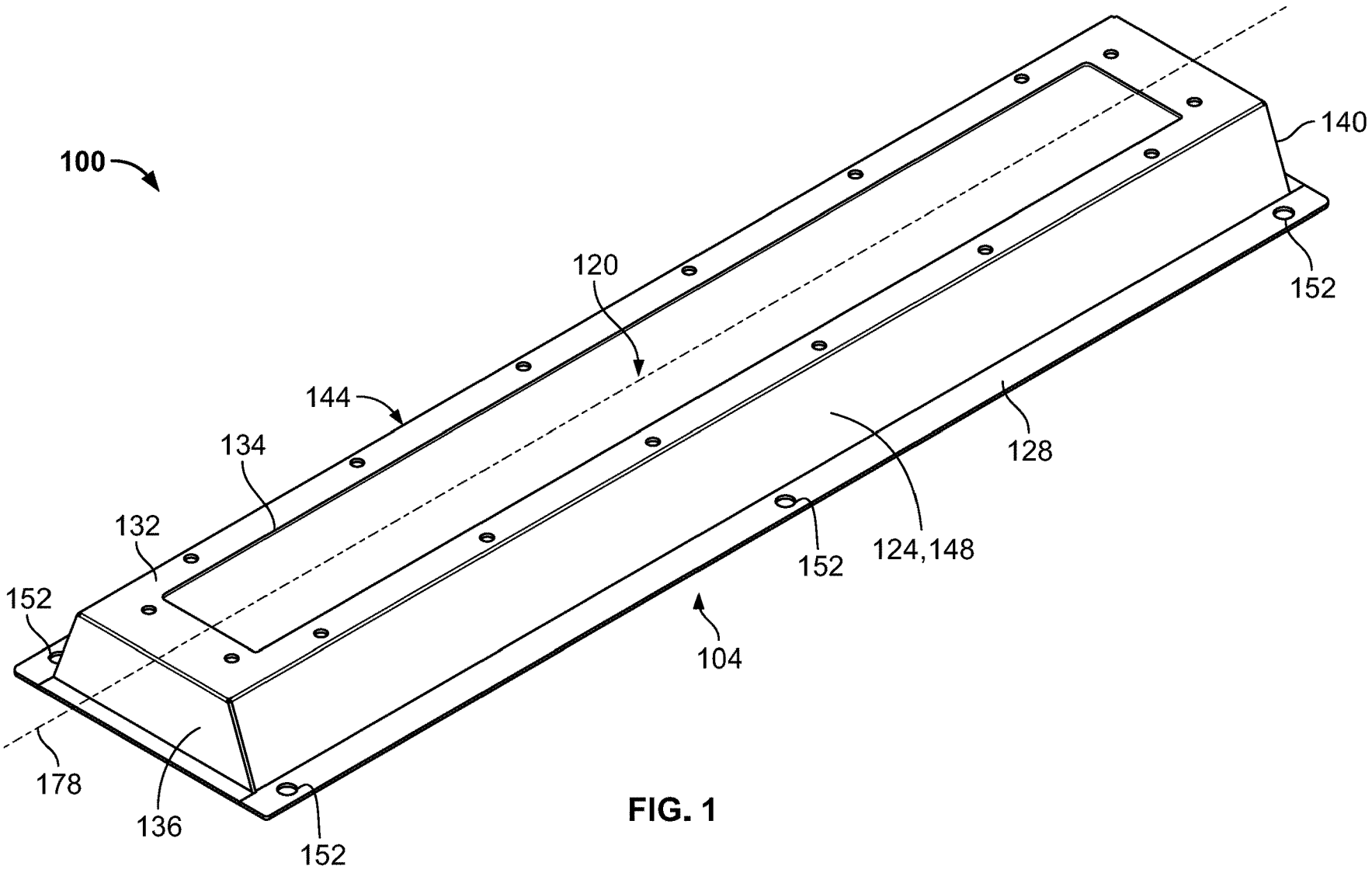
FIG. 1 is a perspective view of a lighting fixture constructed in accordance with the teachings of the present disclosure.

The present disclosure is directed to a lighting fixture for use in a security detention facility, including, but not limited to, a jail, prison, or penitentiary. The lighting fixture disclosed herein has a light source that is configured to provide light to an area surrounding the security detention facility, but the light source has a long-lasting life and does not require maintenance (e.g., repair or replacement). Thus, the light source need not be accessible, such that the lighting fixture can be constructed to prevent access to the interior of the lighting fixture, thereby substantially preventing inmates of the security detention facility from accessing the internal components of the lighting fixture (either to hide weapons or contraband or use the internal components to commit violent acts). Additionally, this prevents inmates of the security detention facility from accessing the internal components of the lighting fixture, such that the lighting fixture is virtually indestructible in the security detention facility.

FIGS. 1-9 illustrate one example of a lighting fixture 100 constructed in accordance with the present disclosure. The lighting fixture 100 is therefore generally adapted to be mounted to a wall, a ceiling, or other surface (not shown) of a secure detention facility. The lighting fixture 100 illustrated in FIGS. 1-9 generally includes a housing 104, a first bracket 108 disposed within the housing 104, a light source 112 coupled to the first bracket 108, a pair of second brackets 116 disposed within the housing 104, and a lens assembly 120 carried by the second brackets 116 within the housing 104. When the lighting fixture 100 is operatively installed within the secure detention facility, the light source 112 can provide light as desired to an area of the secure detention facility surrounding the lighting fixture 100. At the same time, however, the light fixture 100 does not include any type of door, cover, or other component that can be moved to permit access to the interior of the lighting fixture 100, such that the interior of the lighting fixture 100 is not accessible without totally destroying the light fixture 100. In turn, inmates of the secure detention facility are unable to damage or access the light source 112 or other components of the lighting fixture 100.

The housing 104 is generally configured to be mounted directly to the wall, the ceiling, or other surface of the secure detention facility in order to install the lighting fixture 100 in the secure detention facility. As best illustrated in FIG. 1, the housing 104 in this example takes the form of a unitary housing defined by a housing body 124 and a mounting flange 128 that extends outward from the housing body 124. The housing 104 is preferably made of or from a durable material like steel (e.g., 14 gauge steel), but may be made of one or more other suitable materials. The housing body 124 includes a top wall 132, an opening 134 formed in the top wall 132, front and back walls 136, 140 that extend outward from the top wall 132, and first and second side walls 144, 148 that extend outward from the top wall 132 between the front and back walls 136, 140. In this example, the top wall 132 has an elongate, rectangular shape, and the opening 134 likewise has an elongate, rectangular shape. In other examples, however, the top wall 132 may instead have a different shape, such as, for example, a less elongate, rectangular shape, a square shape, a circular shape, or an irregular shape. In those examples, the opening 134 may likewise vary in shape as well. In this example, the front and back walls 136, 140 extend outward from the top wall 132 at an angle of 90 degrees, and the first and second side walls 144, 148 extend outward from the top wall 132 at an angle of between 0 degrees and 45 degrees (e.g., 30 degrees), such that the housing body 124 generally has a substantially trapezoidal profile. In other examples, however, the first and second side walls 144, 148 may extend outward from the top wall 132 at an angle of 90 degrees, such that the housing body 124 generally has a substantially rectangular profile, or the first and second side walls 144, 148 may extend outward from the top wall 132 at some other angle.

In order to mount the housing 104 to the desired surface in the secure detention facility, a plurality of mounting apertures 152 are formed in the mounting flange 128 and are sized receive a plurality of mounting bolts (not shown). In this example, three mounting apertures 152 are formed in each of two opposing sides of the mounting flange 128, thereby providing a total of six mounting apertures 152. In other examples, however, more or less mounting apertures may be formed in the housing 104. Moreover, in other examples, the housing 104 can be mounted to the desired surface in a different manner (e.g., using a different mounting structure than the mounting flange 128).

Figure 2:
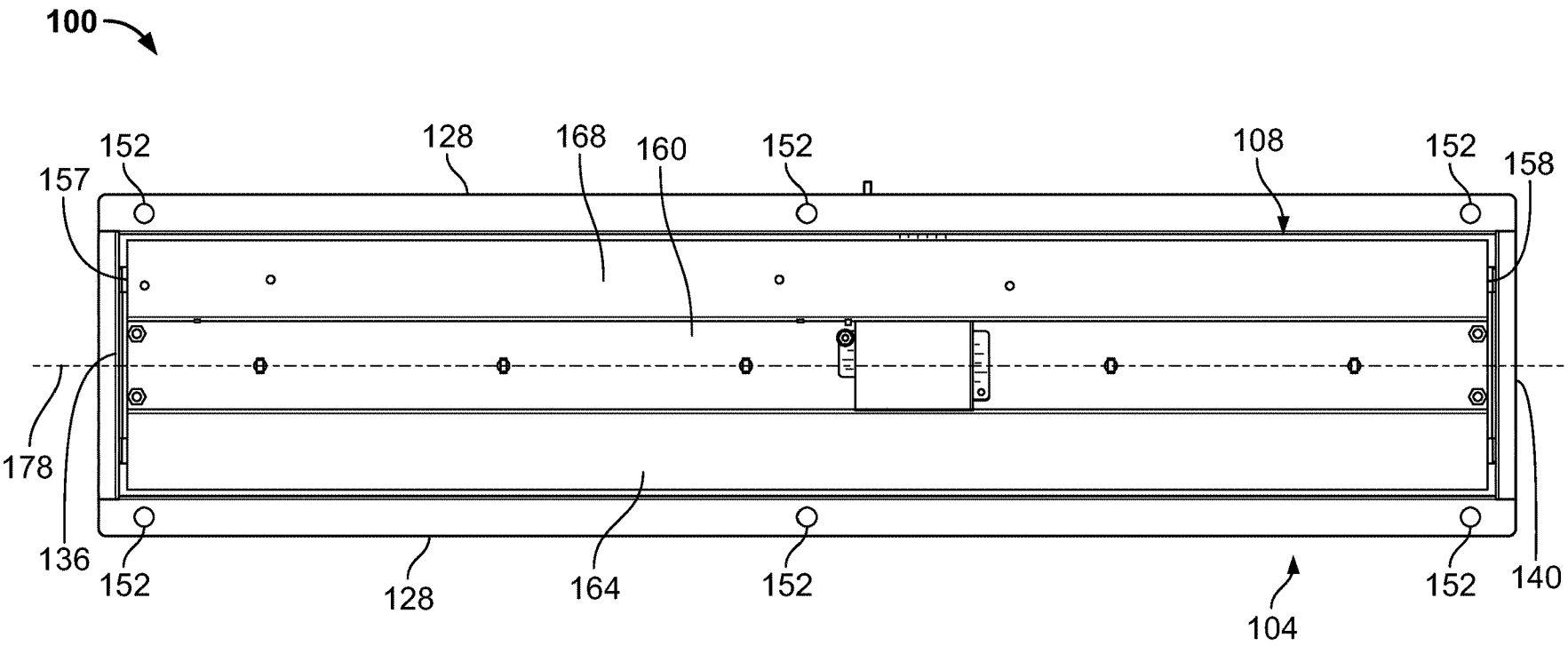
FIG. 2 is a bottom view of the lighting fixture shown in FIG. 1.
Figure 3:
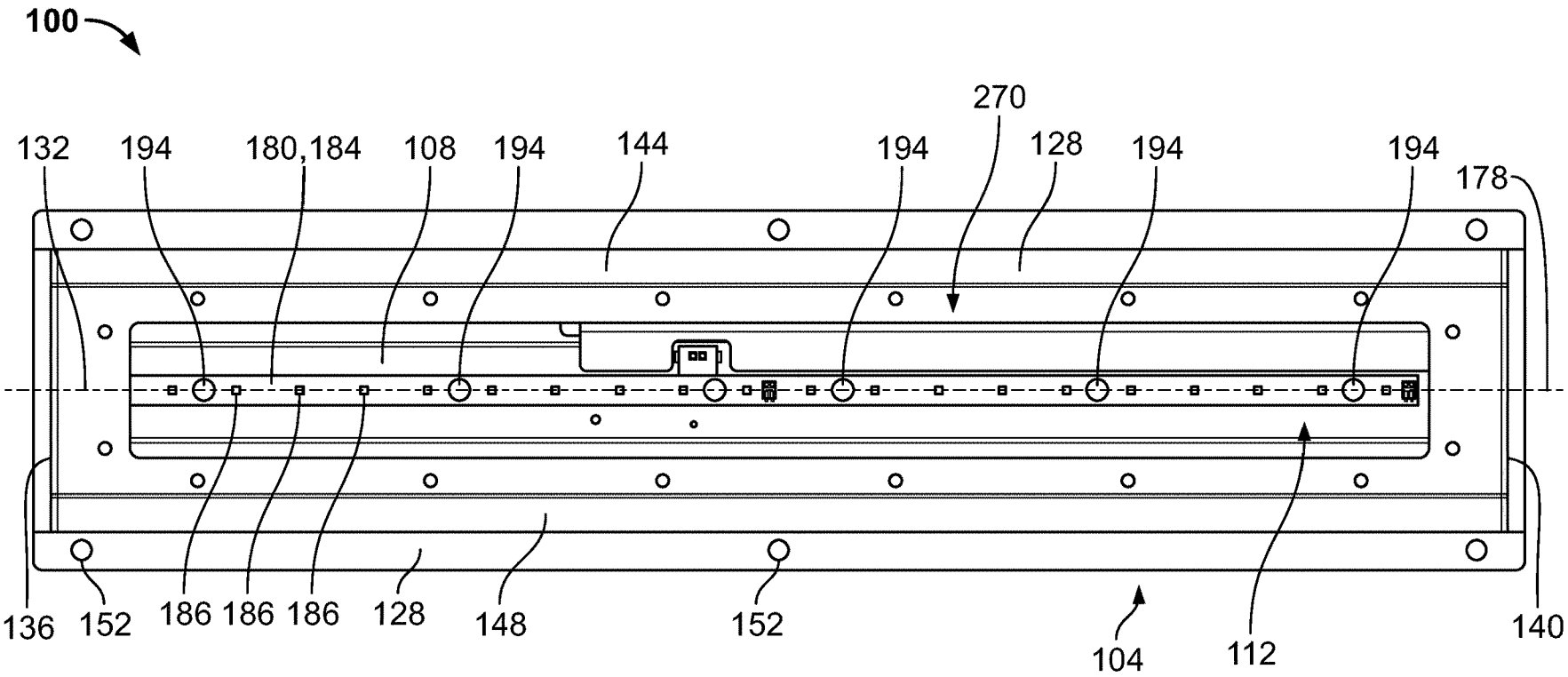
FIG. 3 is a top view of the lighting fixture shown in FIG. 1, but with several components of the lighting fixture removed for illustrative purposes.
Figure 4:
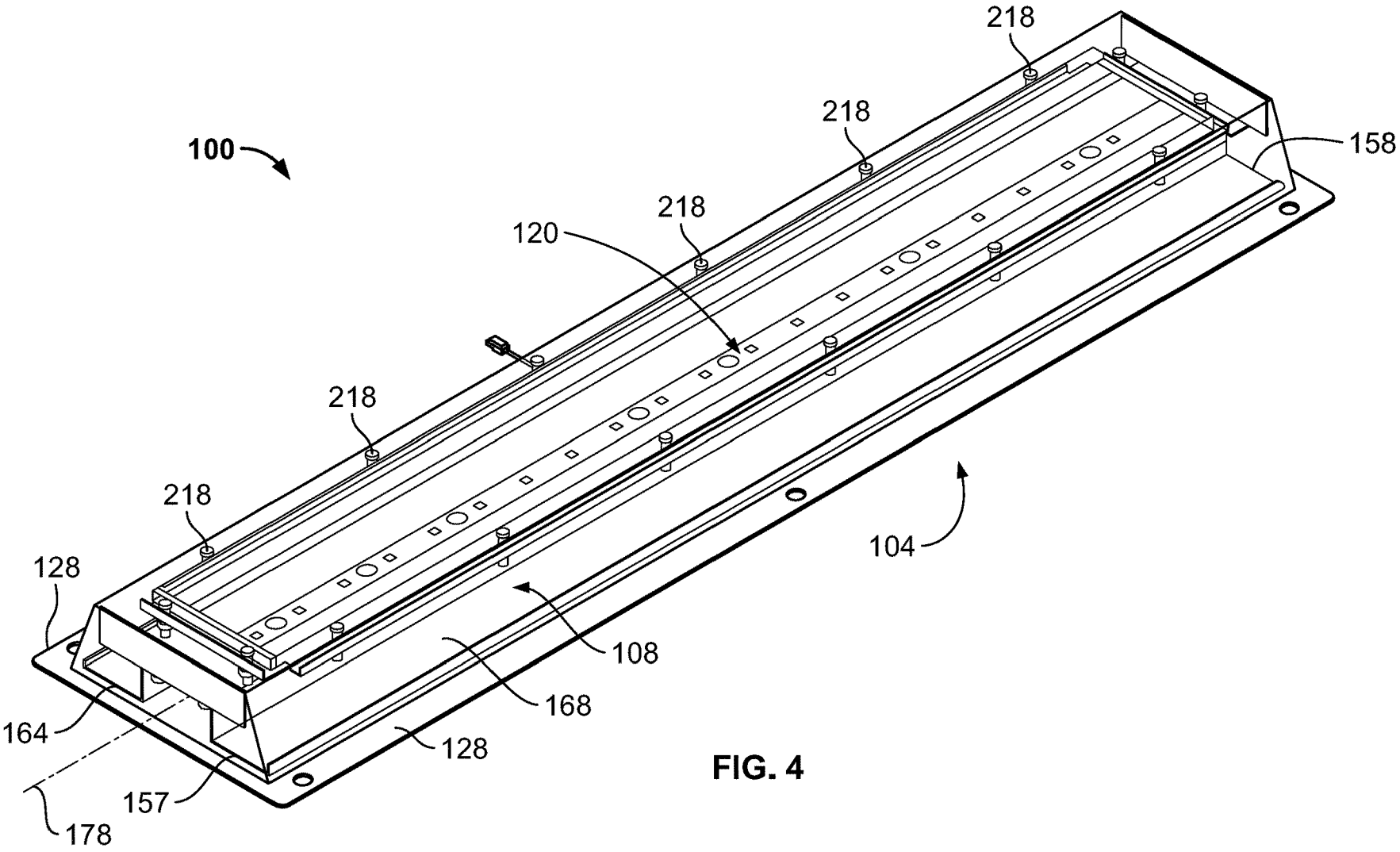
FIG. 4 is similar to FIG. 1, but with several components of the lighting fixture removed for illustrative purposes.
Figure 5:
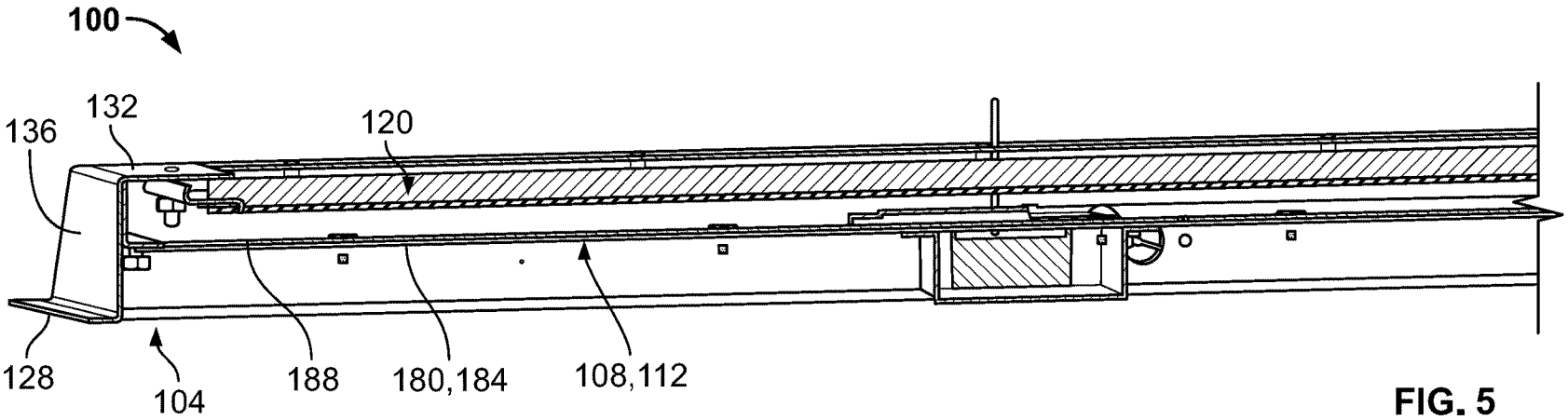
FIG. 5 is a first cross-sectional view of the lighting fixture shown in FIG. 1.
Figure 6:
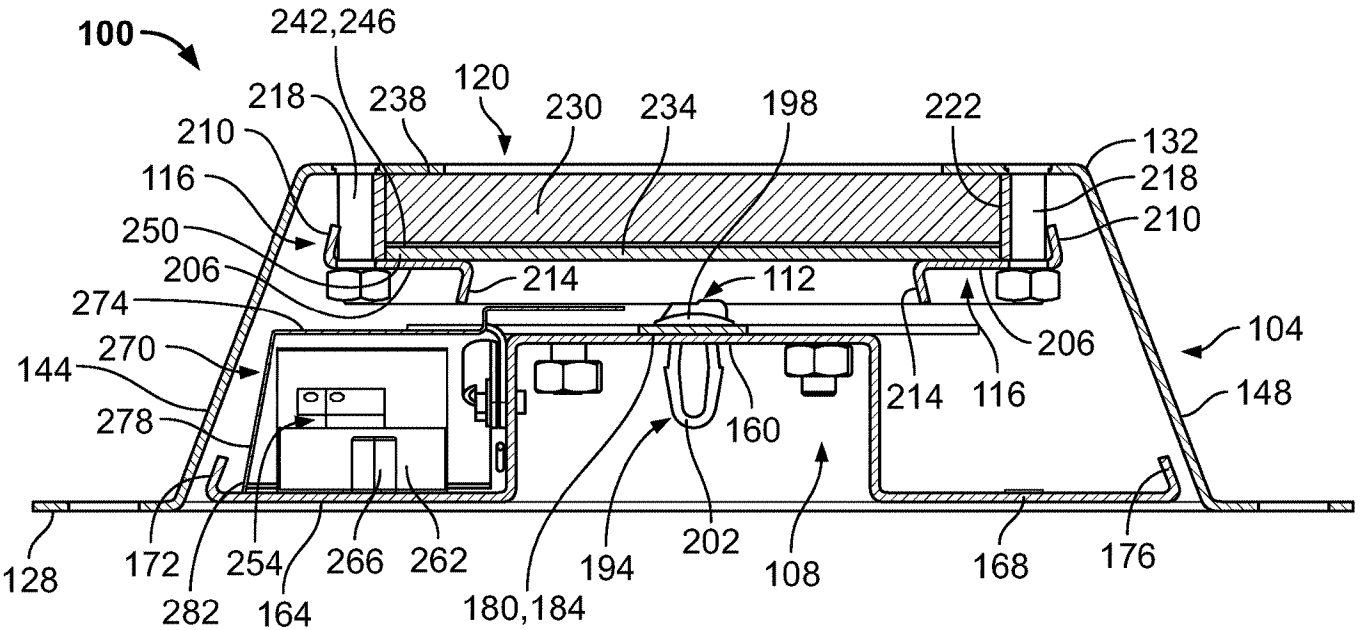
FIG. 6 is a second cross-sectional view of the lighting fixture shown in FIG. 1.
Figure 7:
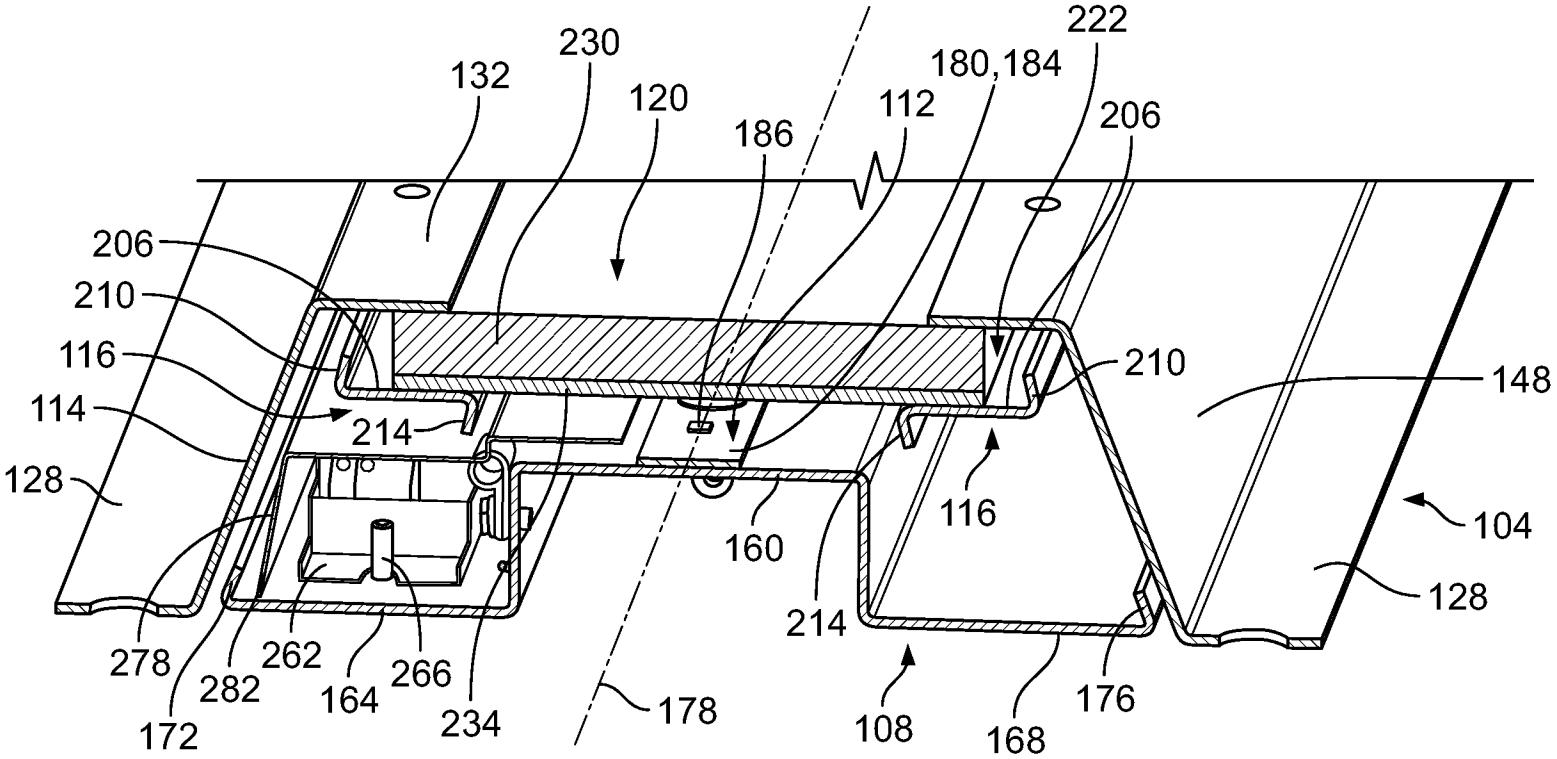
FIG. 7 is a perspective view of the lighting fixture shown in FIG. 6.
Figure 8:
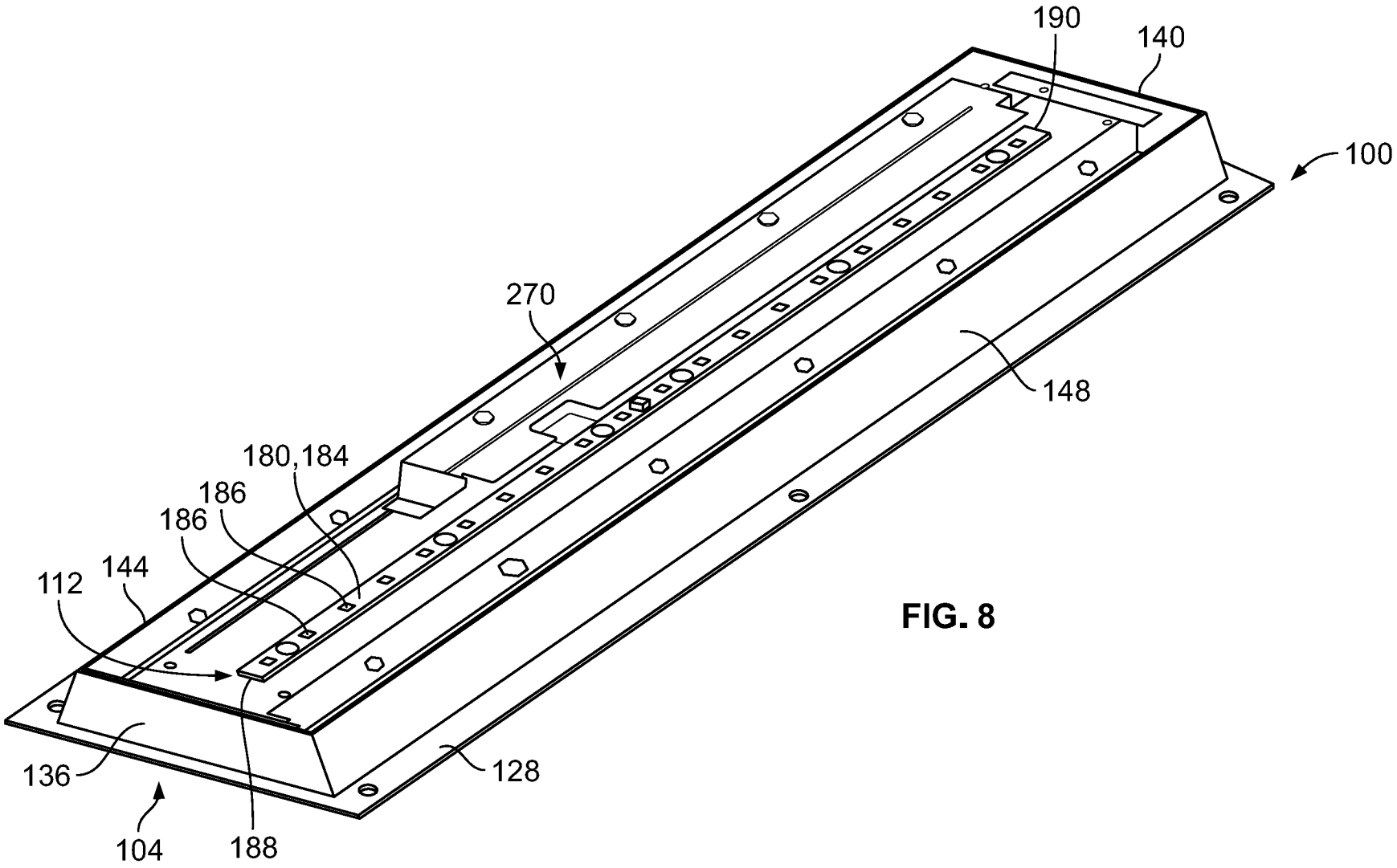
FIG. 8 is similar to FIG. 1, but with several components of the lighting fixture removed for illustrative purposes.

The first bracket 108 is generally configured to support various components of the lighting fixture 100 within the housing 104. As best illustrated in FIGS. 2, 6, and 7, the first bracket 108 in this example is an elongate, U-shaped bracket that extends from a first end 157 to a second end 158 and is defined by a U-shaped body 160, a first wing 164 extending outward from the body 160 in a first direction, and a second wing 168 extending outward from the body 160 in a second direction opposite the first direction. Thus, in this example, the first and second wings 164, 168 are disposed on opposite sides of the U-shaped body 160, with the first and second wings 164, 168 co-axial with one another. As illustrated, the first and second wings 164, 168 include outwardly (upwardly in FIG. 6) extending edges 172, 176, respectively, which help to retain various components of the lighting fixture 100 in the desired position, as will be described in greater detail below. In this example, the edges 172, 176 are oriented at an angle of approximately 45 degrees relative to the first and second wings 164, 168, though in other examples, this angle may vary. Further, in other examples, the first bracket 108 can have a different shape and/or size than the first bracket 108 illustrated in FIGS. 1-9.

While difficult to see in FIGS. 1-9, it will be appreciated that the first bracket 108 is coupled to the housing 104 via a plurality of bolts disposed entirely within the housing 104 (i.e., not exposed outside of the housing 104). Thus, the first bracket 108 is fixedly disposed within an interior of the housing 104 in the manner best illustrated in FIGS. 2 and 4-7. In particular, the first end 157 of the first bracket 108 is disposed immediately adjacent, if not in contact with, the front wall 136 of the housing 104, and the second end 158 of the first bracket 108 is disposed immediately adjacent, if not in contact with, the back wall 140 of the housing 104, such that the first bracket 108 extends along a longitudinal axis 178 of the housing 104 and spans substantially the entire length of the housing 104. Additionally, the U-shaped body 160 is centered between the first and second side walls 144, 148, such that the first wing 164 is disposed between the U-shaped body 160 and the first side wall 144, and the second wing 168 is disposed between the U-shaped body 160 and the second side wall 148. In turn, the first edge 172 is disposed immediately adjacent but inward of the first side wall 144, while the second edge 176 is disposed immediately adjacent but inward of the second side wall 148.

The light source 112 is generally configured to emit light for illuminating portions of the secure detention facility adjacent the lighting fixture 100. In this example, the light source 112 takes the form of printed circuit board (PCB) 180 and a light-emitting diode (LED) board 184 that is arranged on the PCB 180 and includes a plurality of light-emitting diodes (LEDs) 186 configured to emit light. As illustrated, the PCB 180 has a thin, substantially rectangular, and elongate profile that extends between a first end and a second end opposite the first end. Meanwhile, the LED board 184 has a first end 188 that is aligned with the first end of the PCB 180 and a second end 190, opposite the first end 188, that is aligned with the second end of the PCB 180. The LEDs 186 are arranged on the LED board 184 between the first and second ends 188, 190. In this example, twenty (20) LEDs 186 are arranged on the LED board 184, with each of the LEDs 186 disposed in parallel with one another along the longitudinal axis 178 and approximately evenly spaced apart from one another. In other examples, more or less LEDs 186 can be employed, and/or the LEDs 186 can be arranged differently relative to one another and/or the PCB 180. In any case, each of the LEDs 186 preferably has a general lifespan of approximately 87,500 hours, such that the LEDs 186 can last for ten, fifteen, twenty, or even twenty-five years, depending upon the usage of the light fixture 100. Thus, it will be appreciated that the LEDs 186 are designed to last the lifetime of the lighting fixture 100, so need not be maintained (e.g., repaired or replaced).

The light source 112 may be coupled to the first bracket 108 in any number of different ways. In this example, the light source 112 is coupled to the first bracket 108 via a plurality of fasteners 194 that extend through a plurality of apertures (not shown), respectively, formed in each of the first bracket 108, the PCB 180, and the LED board 184. As best illustrated in FIG. 6, each of the fasteners 194 in this example takes the form of a drive fastener having a head 198 and a body 202 that is coupled to and extends outward from the head 198. Each head 198 has a diameter that is larger than a diameter of the corresponding apertures formed in each of the first bracket 108, the PCB 180, and the LED board 184, while each body 202 has a diameter that is less than the diameter of the corresponding apertures. This allows the fasteners 194 to be inserted through the plurality of apertures but yet securely retain the light source 112 in the desired position relative to the first bracket 108. In particular, this allows each head 198 to be positioned on one side of the U-shaped body 160, in this case seated against the LED board 184, and each body 202 to be positioned on the opposite side of the U-shaped body 160, in this case extending outward and away from the light source 112. It will nonetheless be appreciated that the light source 112 can be coupled to the first bracket 108 in any number of different ways. As an example, the light source 112 can be coupled to the first bracket 108 using any other known fasteners. As another example, the light source 112 can be coupled to the first bracket 108 by welding or adhering the PCB 180 to the first bracket 108.

In this example, the light source 112 is coupled to the first bracket 108 such that the PCB 180, and, in turn, the LED board 184 are seated on the U-shaped body 160 of the first bracket 108, with each extending along the longitudinal axis 178 of the housing 104. The PCB 180 and the LED board 184 are preferably centered on the U-shaped body 160 (and the first bracket 108 more generally), though this need not be the case. The first ends of the PCB 180 and the LED board 184 are disposed immediately adjacent the first end 157 of the first bracket 108, while the second ends of the PCB 180 and the LED board 184 are disposed immediately adjacent the second end 158 of the first bracket 108. Thus, the PCB 180 and the LED board 184 substantially span the entire length of the first bracket 108.

Like the first bracket 108, the pair of second brackets 116 is generally configured to support various components of the lighting fixture 100 within the housing 104. As best illustrated in FIGS. 6 and 7, the second brackets 116 in this example are identical, with each of the brackets 116 taking the form of a substantially Z-shaped bracket defined by a substantially flat body 206, a first arm 210 that extends outward from the body 206 in a first direction, and a second arm 214 that extends outward from the body 206 in a second direction opposite the first direction. As best illustrated in FIG. 6, each of the brackets 116 is coupled to the housing 104 via a plurality of bolts 218 disposed entirely within the housing 104 (i.e., not exposed outside of the housing 104). Thus, each of the brackets 116 is fixedly secured to the housing 104 within the interior of the housing 104. More particularly, each of the brackets 116 is disposed between the top side 132 of the housing 104 and the first bracket 108, with one of the brackets 116 extending parallel to but offset from the longitudinal axis 178 in a first direction, and the other of the brackets 116 extending parallel to but offset from the longitudinal axis 178 in a second direction opposite the first direction. The first arm 210 of each of the brackets 116 extends outward toward the top side 132 of the housing 104, while the second arm 214 of each of the bracket 116 extends outward away from the top side 132 and toward the first bracket 108. A receiving channel 222 is therefore defined between the housing 104 (more particularly the top side 132) and the two brackets 116 within the interior of the housing 104.

The lens assembly 120 is generally configured to facilitate distribution of light emitted by the light source 112 to the area of the secure detention facility surrounding the lighting fixture 100. As best illustrated in FIGS. 5-7, the lens assembly 120 in this example includes a first lens 230 and a second lens 234 coupled to the first lens 230. The first lens 230 preferably has an elongate, substantially rectangular shape and is made of or from a polycarbonate material. Meanwhile, the second lens 234 preferably also has an elongate, substantially rectangular shape, but is instead made of or from an acrylic material. In other examples, however, the first and second lenses 230, 234 may be made of or from one or more different materials and/or may have a different shape. It will also be appreciated that the lighting fixture 100 may only include one lens (e.g., the lens 230) or may include more than two lenses.

The lens assembly 120 is generally fixedly coupled to the housing 104 at a position within the interior of the housing 104, such that the lens assembly 120 is non-movably (e.g., non-rotatably) coupled to the housing 104. As best illustrated in FIGS. 4-7, the lens assembly 120 is, at least in this example, fixedly (i.e., non-movably) disposed in the receiving channel 222 defined between the housing 104 and the two brackets 116. In particular, the first lens 230 has a top side 238 that engages an interior facing surface of the top side 132 and a bottom side 242 that is opposite the top side 238. The second lens 234 has a top side 246 that engages the bottom side 242 of the first lens 230 and a bottom side 250 that is seated against and engages the substantially flat body 206 of each of the second brackets 116. Thus, the first lens 230 is positioned against and covers the opening 134 formed in the housing 104, and the second lens 234 is positioned below the first lens 230 and above but adjacent the LEDs 186. In turn, light emitted by the LEDs 186 is provided to the second lens 234, after which the light emitted by the LEDs 186 passes from the second lens 234 to the first lens 230, which distributes the emitted light to the area of the secure detention facility surrounding the light fixture 100. At the same time, the first lens 230 seals the interior of the housing 104 from the environment external to the housing 104. In other words, the first lens 230 prevents access to the interior of the housing 104 and the lighting fixture 100 more generally.

Figure 9:
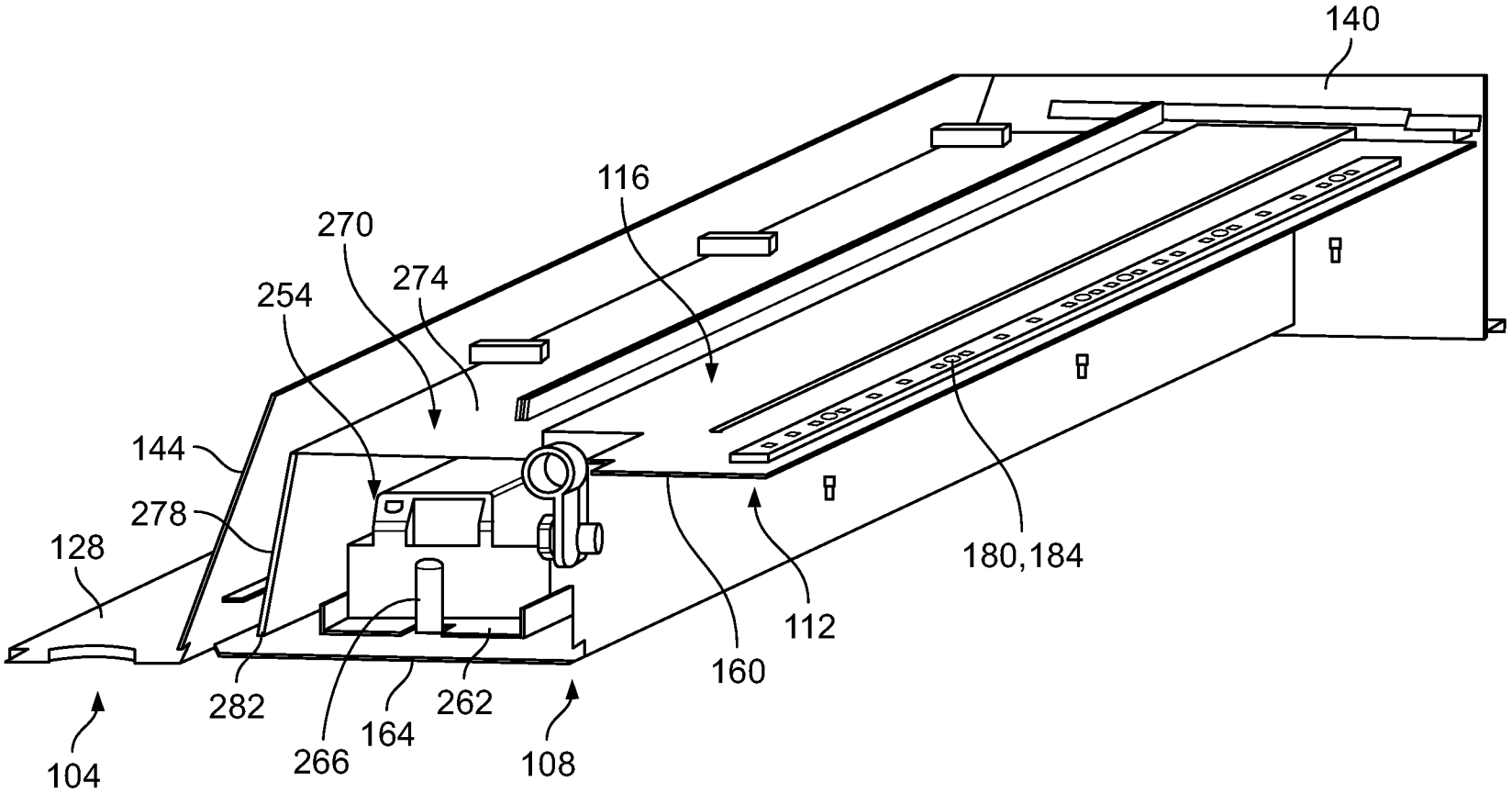
FIG. 9 is a perspective, cross-sectional view of a portion of the lighting fixture shown in FIG. 1.

The lighting fixture 100 in this example also includes a driver 254 generally configured to electrically power the light source 112. In this example, the driver 254 takes the form of an LED driver configured to electrically power the light source 112, particularly the LEDs 186. In other examples, e.g., when the lighting fixture 100 includes different light sources, the driver 254 can be a different type of driver. As illustrated in FIGS. 6, 7, and 9, the driver 254 in this example is fixedly coupled to the first bracket 108 via a pair of mounting brackets 262 (only one of which is visible) carried by the driver 254 and a pair of mounting bolts 266 (only one of which is visible). In other examples, the driver 254 can be coupled to the first bracket 108 in a different manner or can be coupled to a different component of the lighting fixture 100 (e.g., the housing 104 directly) In any case, so coupled, the driver 254 is seated against the first bracket 108, and, more particularly, the first wing 164 of the first bracket 108. The driver 254 is therefore offset from the longitudinal axis 178, as well as the U-shaped body 160, the PCB 180, and the LED board 184, which are disposed along the longitudinal axis 178. In other words, the driver 254 is arranged between the U-shaped body 160 of the first bracket 108 and the first side wall 144 of the housing 104.

The lighting fixture 100 in this example further includes a driver cover 270 arranged to cover and protect the driver 254. The driver cover 270 is generally mounted to the first bracket 108 such that the driver 254 is disposed between the first bracket 108 and the driver cover 270. The driver cover 270 can be so mounted via any known means (e.g., via fasteners, via adhesive, by sandwiching the cover 270 between various components). As illustrated in FIGS. 6-9, the driver cover 270 in this example takes the form of an L-shaped cover defined by a first portion 274 and a second portion 278 that extends outward from and is angled (e.g., at an angle of approximately 30 degrees) relative to the first portion 274. The first portion 274 is substantially flat and overlies a portion of the U-shaped body 160 of the first bracket 108. The second portion 278 terminates at an end 282 that is seated against the first wing 164 of the first bracket 108 at a position between the driver 254 and the first side wall 144 of the housing 104. The end 282 of the second portion 278 is also positioned immediately adjacent to but inward of the first edge 172 of the first bracket 108, which serves to retain the driver cover 270 in the desired position.

Finally, it will be appreciated that the lighting fixture 100 includes additional components disposed in the housing 104. First, the lighting fixture 100 includes wiring that connects the electronic components (e.g., the driver 254, the PCB 180 and the LED board 184) to one another. The lighting fixture 100 may also, for example, include a local controller that communicates data (e.g., operational instructions, motion data) with a central controller or other lighting fixtures 100 in the secure detention facility, one or more communication modules (e.g., one or more antennae, one or more receivers, one or more transmitters) to effectuate wired or wireless communication between the lighting fixtures 100 and a central controller or other lighting fixtures 100, and one or more motion sensors for detecting motion in the area of the secure detention facility. Further, the lighting fixture 100 may include a heat sink or other means for dissipating heat generated by the LEDs 186 within the housing 104. Other components may be disposed in the housing 104 as well. As an example, the lighting fixture 100 may include a nightlight and switch assembly that interfaces between the driver 254 and the LED board 184 to adjust drive current supplied by the driver 254 to the LED board 184.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

The invention claimed is:

1. A lighting fixture for use in a facility, the lighting fixture comprising:

a unitary housing adapted to be mounted to a surface in the facility;

a lens fixedly coupled to the unitary housing;

a first bracket disposed within the unitary housing, the first bracket being structurally separate from the unitary housing; and a light source coupled to the first bracket, the light source comprising a plurality of light-emitting diodes (LEDs), wherein the light source is not accessible when the unitary housing is mounted to the surface in the facility.

2. The lighting fixture of claim 1, wherein the light source comprises a printed circuit board (PCB) and a light-emitting diode (LED) board including the plurality of LEDs, wherein the LED board is arranged on the PCB.

3. The lighting fixture of claim 1, wherein the light source is coupled to the first bracket via a plurality of fasteners.

4. The lighting fixture of claim 1, further comprising:

a second bracket disposed within the unitary housing, wherein the lens is seated against the second bracket within the unitary housing.

5. The lighting fixture of claim 1, further comprising a lens assembly non-movably coupled to the unitary housing, wherein the lens assembly comprises a first lens and a second lens.

6. The lighting fixture of claim 1, wherein the unitary housing comprises a top wall and first and second side walls that extend from the top wall, the lens fixedly coupled to the unitary housing between the top wall and the first bracket, and the lens having a side that directly contacts the top wall of the unitary housing.

7. The lighting fixture of claim 1, wherein the first bracket comprises a body, a first wing extending outward from the body in a first direction, and a second wing extending outward from the body in a second direction opposite the first direction, and wherein the light source is coupled to the body of the first bracket.

8. The lighting fixture of claim 7, further comprising a driver coupled to the first wing of the first bracket, wherein the driver is seated against the first wing of the bracket between the plurality of LEDs and the first and second side walls of the unitary housing at a position offset from the longitudinal axis of the unitary housing.

9. The lighting fixture of claim 8, further comprising a driver cover mounted to the first bracket, wherein the driver is disposed between the first bracket and the driver cover.

10. A lighting fixture for use in a facility, the lighting fixture comprising:

a unitary housing adapted to be mounted to a surface in the facility, the unitary housing having a central longitudinal axis;

a first bracket disposed within the unitary housing;

a light source coupled to the first bracket, the light source comprising a plurality of light-emitting diodes (LEDs) oriented along or parallel to the central longitudinal axis;

a second bracket disposed within the unitary housing;

a lens fixedly coupled to the unitary housing, the lens seated against the second bracket within the unitary housing, wherein the first bracket comprises a body, a first wing extending outward from the body in a first direction, and a second wing extending outward from the body in a second direction opposite the first direction, and wherein the light source is coupled to the body of the first bracket;

a driver coupled to the first wing of the first bracket, wherein the driver is seated against the first wing of the bracket at a position offset from the central longitudinal axis of the unitary housing; and a driver cover mounted to the first bracket, wherein the driver is disposed between the first bracket and the driver cover.

11. The lighting fixture of claim 10, wherein the light source comprises a printed circuit board (PCB) and a light-emitting diode (LED) board including the plurality of LEDs, wherein the LED board is arranged on the PCB such that the LED board extends along the central longitudinal axis.

12. A lighting fixture for use in a facility, the lighting fixture comprising:

a unitary housing adapted to be mounted to a surface in the facility;

a first bracket disposed within the unitary housing;

a light source coupled to the first bracket, the light source comprising a plurality of light-emitting diodes (LEDs);

a second bracket disposed within the unitary housing; and a lens fixedly coupled to the unitary housing, the lens seated against the second bracket within the unitary housing, wherein the unitary housing comprises a top wall and first and second side walls that extend from the top wall, the lens fixedly coupled to the unitary housing between the top wall and the first bracket, and the lens having a side that directly contacts the top wall of the unitary housing.

13. The lighting fixture of claim 12, wherein the first bracket comprises a body, a first wing extending from the body and disposed between the body and the first side wall, and a second wing extending from the body and disposed between the body and the second side wall.

14. A lighting fixture for use in a facility, the lighting fixture comprising:

a unitary housing adapted to be mounted to a surface in the facility;

a first bracket disposed within the unitary housing, the first bracket being structurally separate from the unitary housing;

a light source coupled to the first bracket via a plurality of fasteners, the light source comprising a plurality of light-emitting diodes (LEDs);

a second bracket fixedly disposed within the unitary housing;

a lens seated against the second bracket within the unitary housing;

a driver configured to electrically power the light source; and a driver cover mounted to the first bracket, wherein the driver is disposed between the first bracket and the driver cover.

15. The lighting fixture of claim 14, wherein the light source comprises a printed circuit board (PCB) and a light-emitting diode (LED) board including the plurality of LEDs, wherein the LED board is arranged on the PCB.

16. The lighting fixture of claim 14, wherein the first bracket comprises a body, a first wing extending from the body, and a second wing extending from the body, and wherein the light source is coupled to the body of the first bracket.

17. The lighting fixture of claim 16, wherein the driver is seated against the first wing of the bracket at a position offset from a longitudinal axis of the unitary housing.

18. The lighting fixture of claim 14, wherein the unitary housing comprises a top wall and first and second side walls that extend from the top wall, the lens fixedly coupled to the unitary housing between the top wall and the first bracket, and the lens having a side that directly contacts the top wall of the unitary housing.

* * * * *